US010484775B1

(12) United States Patent
Li

(10) Patent No.: US 10,484,775 B1
(45) Date of Patent: Nov. 19, 2019

(54) EARPHONE STRUCTURE

(71) Applicant: ETEN ELECTRONICS LIMITED, Sacramento, CA (US)

(72) Inventor: Jia Li, Nanning (CN)

(73) Assignee: ETEN ELECTRONCIS LIMITED, Sacramento, CA (US)

( * ) Notice: Subject to any disclaimer, the term of this patent is extended or adjusted under 35 U.S.C. 154(b) by 0 days.

(21) Appl. No.: 16/156,751

(22) Filed: Oct. 10, 2018

(30) Foreign Application Priority Data

Jul. 16, 2018 (CN) ..... 2018 1 0815774

(51) Int. Cl.
*H04R 1/10* (2006.01)

(52) U.S. Cl.
CPC ..... *H04R 1/1016* (2013.01); *H04R 1/1058* (2013.01)

(58) Field of Classification Search
CPC ..... H04R 1/10; H04R 1/1008; H04R 1/1016; H04R 1/105; H04R 1/1058; H04R 1/1066; H04R 1/1075
USPC ..... 381/380
See application file for complete search history.

(56) References Cited

U.S. PATENT DOCUMENTS 1,674,683 A * 6/1928 Hahnemann ..... H04R 3/14 381/186
4,469,921 A * 9/1984 Kinoshita ..... G10K 11/025 181/187
5,526,456 A * 6/1996 Heinz ..... H04R 1/26 181/152
6,034,409 A * 3/2000 Sakai ..... H01L 21/76232 257/506
6,094,495 A * 7/2000 Rocha ..... H04R 1/30 181/152
6,389,144 B1 * 5/2002 Lee ..... H04R 1/345 381/340
7,068,805 B2 * 6/2006 Geddes ..... G10K 11/025 181/187
8,130,995 B2 * 3/2012 Her ..... H04R 1/1075 379/430

(Continued)

FOREIGN PATENT DOCUMENTS

CN 203872333 * 10/2014 ..... H04R 1/10
CN 204836458 * 12/2015 ..... H04R 1/02
JP 408037697 * 7/1994 ..... H04R 1/1016

*Primary Examiner* — Oyesola C Ojo
(74) *Attorney, Agent, or Firm* — Billion & Armitage; Michael A. Collins

(57) ABSTRACT

An earphone structure is provided, relating to the technical field of earphones. The earphone structure includes: a speaker, including a sound producing vibrating diaphragm and a sound outlet, wherein the sound producing vibrating diaphragm is used to convert an electrical signal to a sound which is output through the sound outlet; a pipe, wherein the pipe has one end provided at a side of the speaker having the sound outlet, and the other end extending along a direction away from the sound outlet, such that the sound output from the sound outlet is transmitted to an outside space. With the above provision, a problem of easy occurrence of reflection of sound waves within a cavity due to presence of the cavity between the pipe and the sound outlet in the prior art, thereby overcoming a problem of sound coloration caused by the occurrence of reflection of the sound waves.

14 Claims, 4 Drawing Sheets

(56) References Cited

U.S. PATENT DOCUMENTS

| | | | | |
|---|---|---|---|---|
| 8,160,285 | B2 * | 4/2012 | Kragelund | H04R 1/345 381/150 |
| 8,213,658 | B2 * | 7/2012 | Robineau | H04R 1/30 181/192 |
| 8,548,184 | B2 * | 10/2013 | Werner | H04R 1/345 181/177 |
| 9,131,311 | B2 * | 9/2015 | Lumsden | H04R 1/1016 |
| 9,197,959 | B2 * | 11/2015 | Fukushima | H04R 1/1058 |
| 9,319,767 | B2 * | 4/2016 | Sakaguchi | H04R 1/2811 |
| 9,813,807 | B2 * | 11/2017 | Epping | H04R 1/1016 |
| 2004/0178171 | A1 * | 9/2004 | Nagarajan | G01P 15/0802 216/13 |
| 2005/0078844 | A1 * | 4/2005 | Von Ilberg | H04R 25/04 381/322 |
| 2009/0116676 | A1 * | 5/2009 | Welsh | H04R 1/1075 381/380 |
| 2009/0154750 | A1 * | 6/2009 | Kragelund | G10K 11/02 381/338 |
| 2011/0261985 | A1 * | 10/2011 | Rung | H04R 25/48 381/323 |
| 2011/0311070 | A1 * | 12/2011 | Epping | H04R 1/1016 381/74 |

* cited by examiner

EARPHONE STRUCTURE

CROSS-REFERENCE TO RELATED APPLICATIONS

The present application claims the priority to the Chinese patent application with the filing No. CN201810815774.8, filed with the State Intellectual Property Office on Jul. 16, 2018 and entitled "Earphone Structure", contents of which are incorporated herein by reference in its entirety. A claim of priority is made.

TECHNICAL FIELD

The present disclosure relates to the technical field of earphones, and particularly to an earphone structure.

BACKGROUND

With the improvement on people's living quality, music has become a conventional method for relieving pressure in daily life. Moreover, earphones as portable music playing devices are widely used. The earphones generally include open earphones and closed earphones, compared with the open earphones, the closed earphones have better effects at all frequency bands of the music.

Researches of the inventor reveal that existing closed earphones have a problem of poor user experience in sound field and sense of space, and through analysis and researches, it has found that this problem is caused by sound coloration resulted from reflection of sound waves present in existing earphone structures.

SUMMARY

In view of this, an object of the present disclosure is to provide an earphone structure so as to avoid the problem of easy occurrence of reflection of the sound waves within a cavity due to presence of the cavity between the pipe and the sound outlet in the prior art, thereby overcoming the problem of sound coloration caused by the occurrence of reflection of the sound waves, and further overcoming the problem of user's poor experience in the sound field and the sense of space.

In order to achieve the above object, following technical solutions are used in embodiments of the present disclosure.

An earphone structure includes:

a speaker, including a sound producing vibrating diaphragm and a sound outlet, wherein the sound producing vibrating diaphragm is used to convert an electrical signal to a sound which is output through the sound outlet; and a pipe, wherein the pipe has one end provided at a side of the speaker having the sound outlet, and the other end extending along a direction away from the sound outlet, such that the sound output from the sound outlet is transmitted to an outside space.

In some embodiments of the present disclosure, in the above earphone structure, areas of cross sections of the pipe in a radial direction are successively increasing in a direction from being close to the sound outlet to being away from the sound outlet.

In some embodiments of the present disclosure, in the above earphone structure, the pipe is divided into multiple portions successively in the direction away from the sound outlet, wherein two neighboring portions are connected by a transition portion parallel to end faces of the two portions, so as to form a step-shape structure.

In some embodiments of the present disclosure, in the above earphone structure, a cross section of each portion of the pipe in an axial direction is an isosceles trapezoidal shape, and legs of any two isosceles trapezoidal shapes on same sides are parallel to each other.

In some embodiments of the present disclosure, in the above earphone structure, in any two neighboring isosceles trapezoidal shapes, one isosceles trapezoidal shape close to the sound outlet has a height smaller than that of the other isosceles trapezoidal shape that is away from the sound outlet.

In some embodiments of the present disclosure, in the above earphone structure, the cross sections of the pipe in the radial direction are in a circular shape, and have diameters successively increasing in the direction away from the sound outlet.

In some embodiments of the present disclosure, in the above earphone structure, the cross sections of the pipe in the radial direction are in an ellipse shape, and have major axes and minor axes respectively increasing successively in the direction away from the sound outlet.

In some embodiments of the present disclosure, in the above earphone structure, the cross section of the pipe in the radial direction includes:

a first arc-shape portion;

a second arc-shape portion, having a radius of curvature smaller than that of the first arc-shape portion, wherein a first end of the second arc-shape portion is connected to a first end of the first arc-shape portion;

a third arc-shape portion, having a radius of curvature equal to that of the first arc-shape portion, wherein a first end of the third arc-shape portion is connected to a second end of the second arc-shape portion; and a fourth arc-shape portion, having a radius of curvature equal to that of the second arc-shape portion, wherein a first end of the fourth arc-shape portion is connected to a second end of the third arc-shape portion, and a second end of the fourth arc-shape portion is connected to a second end of the first arc-shape portion.

In some embodiments of the present disclosure, in the above earphone structure, an arc length of the first arc-shape portion is equal to that of the third arc-shape portion, an arc length of the second arc-shape portion is equal to that of the fourth arc-shape portion and is smaller than that of the first arc-shape portion.

An embodiment of the present disclosure further provides another earphone structure, including:

a speaker, including a casing, a sound producing vibrating diaphragm, and a sound outlet, wherein the sound producing vibrating diaphragm is provided inside the casing, the sound outlet is provided on a surface of the casing, wherein the sound producing vibrating diaphragm is used to convert an electrical signal to a sound which is output through the sound outlet;

a pipe, wherein the pipe has one end provided at a side of the speaker having the sound outlet, and the other end extending along a direction away from the sound outlet, such that the sound output from the sound outlet is transmitted to an outside space;

a fixing portion provided in the casing, wherein the fixing portion is integrally molded with the pipe, such that the pipe is fixed to the speaker through the fixing portion.

With the earphone structure provided in the present disclosure, by directly providing one end of the pipe at the side of the speaker having the sound outlet, the sound output from the sound outlet can be transmitted to the outside space directly through the pipe, thus avoiding the problem of easy occurrence of reflection of the sound waves within a cavity due to presence of the cavity between the pipe and the sound outlet in the prior art, thereby overcoming the problem of sound coloration caused by the occurrence of reflection of the sound waves, and further overcoming the problem of poor user experience in the sound field and the sense of space.

Furthermore, by providing the pipe in the step-shape structure, the diffusion sound transmission path can be formed, thus an object of quickly and effectively outputting the sound from the pipe is achieved, further improving the sound field and the sense of space of the sound.

In order to make the above objects, features, and advantages of the present disclosure clearer and more understandable, below preferable embodiments are specifically illustrated in combination with attached accompanying drawings to make detailed description as follows.

Reference signs: 100—earphone structure; 110—speaker; 111—sound producing vibrating diaphragm; 113—sound outlet; 115—casing; 117—front cover; 130—pipe; 131—first portion; 132—second portion; 133—sixth portion; 134—transition portion; 135—first arc-shape portion; 136—second arc-shape portion; 137—third arc-shape portion; 138—fourth arc-shape portion; 150—fixing portion.

DETAILED DESCRIPTION OF EMBODIMENTS

In order to make the objects, technical solutions, and advantages of the embodiments of the present disclosure clearer, below the technical solutions in the embodiments of the present disclosure will be described clearly and completely in conjunction with the accompanying drawings in the embodiments of the present disclosure. Apparently, some but not all embodiments of the present disclosure are described. Generally, components in the embodiments of the present disclosure, as described and shown in the accompanying drawings herein, may be arranged and designed in different configurations.

Therefore, the following detailed description of the embodiments of the present disclosure provided in the accompanying drawings is not intended to limit the scope of protection of the present disclosure, but merely illustrates chosen embodiments of the present disclosure. On the basis of the embodiments of the present disclosure, all of other embodiments, obtained by a person ordinarily skilled in the art without paying inventive effort, should fall within the scope of protection of the present disclosure.

It should be noted that similar reference signs and letters represent similar items in the following accompanying drawings. Therefore, once a certain item is defined in one accompanying drawing, it is not needed to be further defined or explained in subsequent accompanying drawings. In the description of the present disclosure, terms "first", "second", "third", "fourth" and so on are merely for distinctive description, but should not be construed as indicating or implying relative importance.

In the description of the present disclosure, unless otherwise specified and defined explicitly, terms "provide", "join", and "connect" should be construed in a broad sense, for example, it may be fixed connection, detachable connection, or integral connection; it may be mechanical connection, and also may be electrical connection; it may be direct connection, indirect connection through an intermediate medium, or inner communication between two elements. For a person ordinarily skilled in the art, specific meanings of the above-mentioned terms in the present disclosure can be understood according to specific circumstances.

Figure 1:
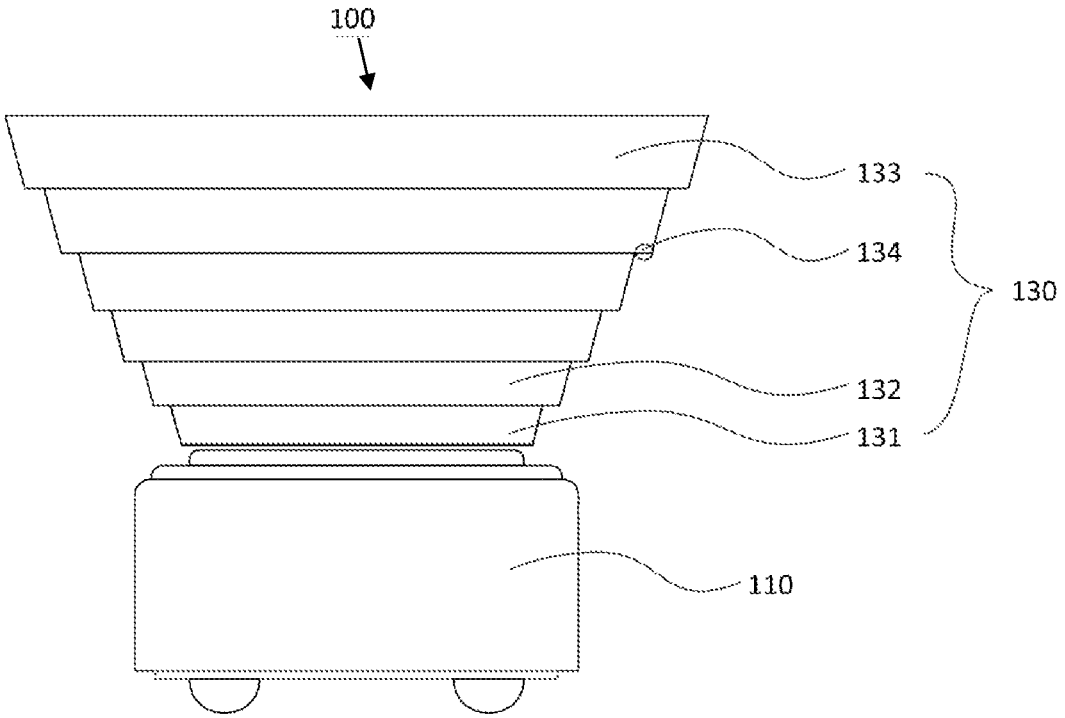
FIG. 1 is a structural schematic diagram of an earphone structure provided in an embodiment of the present disclosure.

As shown in FIG. 1, an embodiment of the present disclosure provides an earphone structure 100, which may include a speaker 110 and a pipe 130, wherein the speaker 110 is used to convert an electrical signal to a sound, and the pipe 130 is used to transmit the sound to an outside space.

Figure 2:
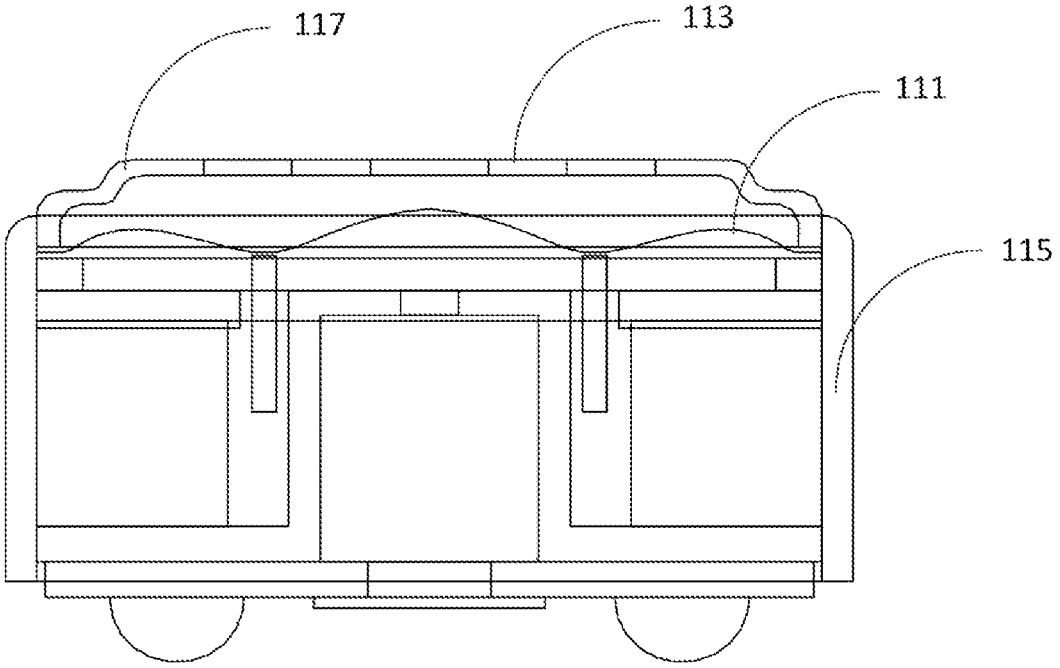
FIG. 2 is a structural schematic diagram of a speaker provided in an embodiment of the present disclosure.

Furthermore, in the present embodiment, in combination with FIG. 2, the speaker 110 may include a sound producing vibrating diaphragm 111 and a sound outlet 113. The sound producing vibrating diaphragm 111 is used to convert the electrical signal to the sound which is output through the sound outlet 113. The pipe 130 has one end provided at a side of the speaker 110 having the sound outlet 113, and the other end extending along a direction away from the sound outlet 113, such that the sound output from the sound outlet 113 is transmitted to the outside space.

Moreover, one end of the pipe 130 is directly provided at the side of the speaker 110 having the sound outlet 113, that is to say, the sound output through the sound outlet 113 may directly enter the pipe 130, so as to avoid a problem of sound coloration caused by formation of reflected sound waves between the sound outlet 113 and the pipe 130, wherein the sound coloration refers to overlapping of the reflected sound waves with original sound waves.

Optionally, a specific shape structure of the speaker 110 is not limited, and may be provided according to practical application requirements, as long as the electrical signal can be effectively converted to the sound and output. In the present embodiment, the speaker 110 may further include a casing 115.

In the above, the casing 115 has a receiving space. The sound producing vibrating diaphragm 111 may be provided inside the casing 115 through the receiving space, moreover, the sound outlet 113 may be provided on a surface of the casing 115, such that a sound generated by the sound producing vibrating diaphragm 111 is transmitted to the casing 115.

Optionally, a manner of providing the sound outlet 113 is not limited, and it may be provided according to practical application requirements. In the present embodiment, the speaker 110 may further include a front cover 117. The front cover 117 is provided at a side of the casing 115, and the sound outlet 113 is formed by defining a through hole on the front cover 117.

In the above, the number of the sound outlet 113 is not limited, and may be provided according to practical application requirements, for example, when the sound outlet 113 has a relatively big area, the number may be relatively small, and when the sound outlet 113 has a relatively small area, the number may be relatively large, as long as the sound generated by the sound producing vibrating diaphragm 111 can be effectively transmitted to the outside of the casing 115.

Furthermore, in the present embodiment, the speaker 110 may further include a circuit board, a magnet, a magnetically conductive plate, coil, an electrode slice, a copper ring, and other structures, such that it is convenient for the sound producing vibrating diaphragm 111 to convert the electrical signal to the sound.

In the above, relative positional relationships of the circuit board, the magnet, the magnetically conductive plate, the coil, the electrode slice, the copper ring, and other structures within the casing 115 are not specifically defined, and may be provided according to practical application requirements.

Optionally, a specific shape structure of the pipe 130 is not limited, and it may be provided according to practical application requirements, for example, it may be provided according to transmission efficiency of sound and other elements. In the present embodiment, in order to conveniently transmit the sound quickly from the pipe 130 to the outside space, the pipe 130 may be increasing successively in a direction from being close to the sound outlet 113 to being away from the sound outlet 113, that is to say, areas of cross sections of the pipe 130 in a radial direction are increasing successively in the direction away from the sound outlet 113.

In the above, a manner of increasing the areas of the cross sections of the pipe 130 in the radial direction is not limited, and may be provided according to practical application requirements, for example, the areas of the cross sections of the pipe 130 in the radial direction may be increasing according to a certain rule, and also may be increasing arbitrarily. In the present embodiment, the pipe 130 is divided into multiple portions successively in the direction away from the sound outlet 113.

Moreover, for the multiple portions, any two neighboring portions are connected by a transition portion 134 parallel to end faces of the two portions, so as to form a step-shape structure. By providing the pipe 130 in the step-shape structure, a diffusion sound transmission path can be formed, and an object of quickly and effectively outputting the sound from the pipe 130 can be achieved, thus improving the sound field and the sense of space of the sound.

Optionally, a specific number of the multiple portions is not limited, and it may be provided according to practical application requirements, for example, it may be provided according to quality requirements to sound transmission or a manufacturing process. In the present embodiment, the multiple portions may include 6 portions, respectively being a first portion 131, a second portion 132 . . . a sixth portion 133 successively in the direction away from the sound outlet 113.

Optionally, a shape of each portion among the multiple portions is not limited, and it may be provided according to practical application requirements. In the present embodiment, a cross section of each portion of the pipe 130 in an axial direction is in an isosceles trapezoidal shape.

Moreover, various isosceles trapezoidal shapes may have a same shape, and also may have different shapes. In the present embodiment, legs of any two isosceles trapezoidal shapes on the same sides are parallel to each other, that is to say, angles defined by legs and base edges of any two isosceles trapezoidal shapes are the same. In the above, magnitudes of the angles are not limited and may be provided according to practical application requirements, and no specific definition is made herein.

Optionally, heights of various isosceles trapezoidal shapes are not limited, and may be provided according to practical application requirements, for example, they may be the same, and also may be different. In the present embodiment, heights of the various isosceles trapezoidal shapes may be different, moreover, they are provided according to a certain rule, for example, in any two neighboring isosceles trapezoidal shapes, one isosceles trapezoidal shape close to the sound outlet 113 has a height smaller than that of the other isosceles trapezoidal shape that is away from the sound outlet 113.

Optionally, shapes of the cross sections of the pipe 130 in the radial direction are not limited, and may be provided according to practical application requirements, for example, they not only may be irregular shapes, but also may be regular shapes, for example, they may include, but not limited to, circular shapes, square shapes, triangular shapes or ellipse shapes, and so on.

Figure 3:
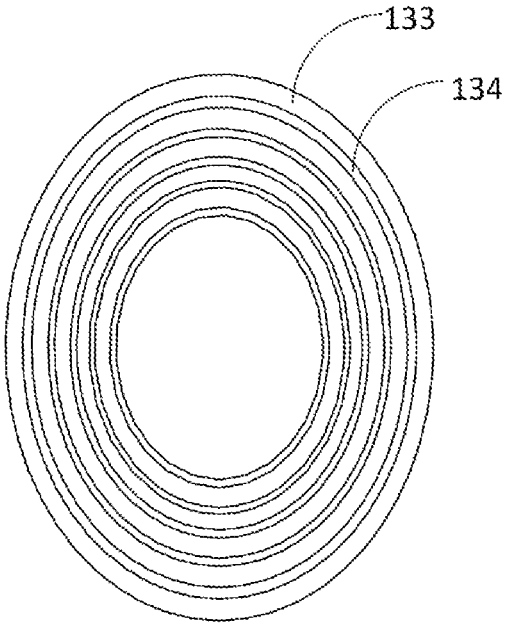
FIG. 3 is a structural schematic diagram of a pipe provided in an embodiment of the present disclosure.

In the above, in one example, as shown in FIG. 3, the cross sections of the pipe 130 in the radial direction may be in a circular shape, moreover, diameters of the cross sections of the pipe 130 in the radial direction are successively increasing in the direction away from the sound outlet 113.

Figure 4:
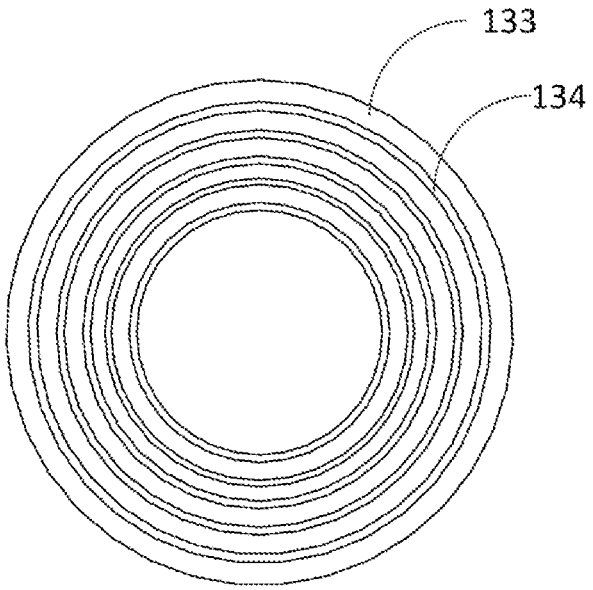
FIG. 4 is another structural schematic diagram of the pipe provided in an embodiment of the present disclosure.

In another example, as shown in FIG. 4, the cross sections of the pipe 130 in the radial direction may be in an ellipse shape, and major axes and minor axes of the cross sections of the pipe 130 in the radial direction are respectively increasing successively in the direction away from the sound outlet 113.

Figure 5:
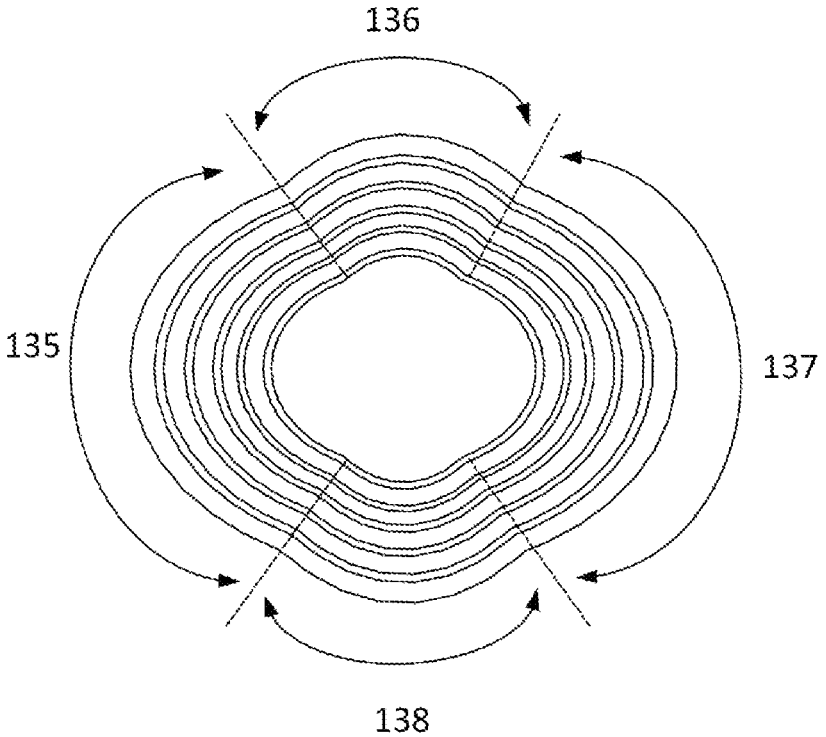
FIG. 5 is another structural schematic diagram of the pipe provided in an embodiment of the present disclosure.

Furthermore, in the present embodiment, a pipe 130 as shown in FIG. 5 is further provided, and each cross section of the pipe 130 in a radial direction may consist of four portions connected head to tail. In the above, the four portions may be a first arc-shape portion 135, a second arc-shape portion 136, a third arc-shape portion 137, and a fourth arc-shape portion 138, respectively.

Moreover, a first end of the second arc-shape portion 136 is connected to a first end of the first arc-shape portion 135, a first end of the third arc-shape portion 137 is connected to a second end of the second arc-shape portion 136, a first end of the fourth arc-shape portion 138 is connected to a second end of the third arc-shape portion 137, and a second end of the fourth arc-shape portion 138 is connected to a second end of the first arc-shape portion 135.

In the above, in order to form a oriented diffusion structure by the above four arc-shape portions, a radius of curvature of the first arc-shape portion 135 may be equal to that of the third arc-shape portion 137, a radius of curvature of the second arc-shape portion 136 may be equal to that of the fourth arc-shape portion 138, and a radius of curvature of the second arc-shape portion 136 may be smaller than to that of the first arc-shape portion 135.

Optionally, arc lengths of the above four arc-shape portions are not limited, and may be provided according to practical application requirements. In the present embodiment, the arc length of the first arc-shape portion 135 may be equal to that of the third arc-shape portion 137, the arc length of the second arc-shape portion 136 may be equal to that of the fourth arc-shape portion 138 and may be smaller than that of the first arc-shape portion 135.

Figure 6:
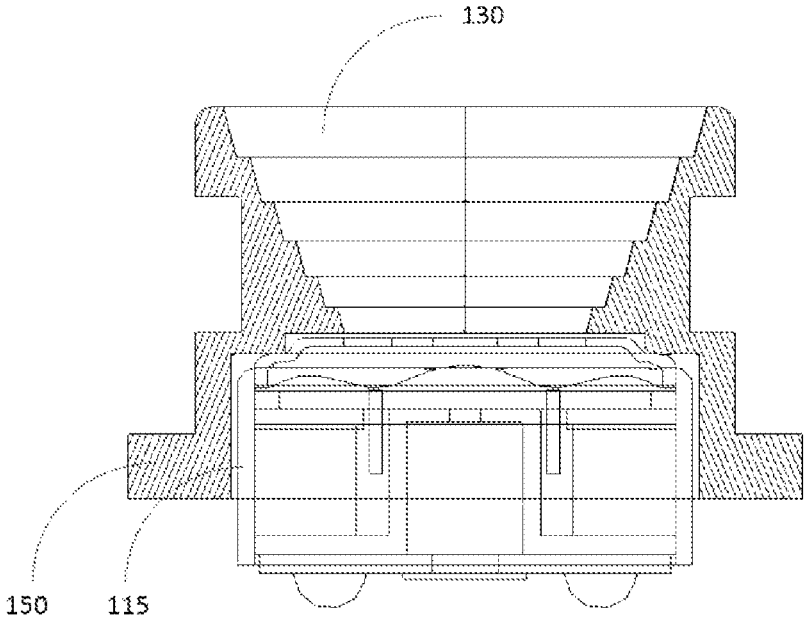
FIG. 6 is another structural schematic diagram of the earphone structure provided in an embodiment of the present disclosure.

Furthermore, in order to ensure stability of the provision of the pipe 130 and the speaker 110, in the present embodiment, in combination with FIG. 6, the earphone structure 100 may further include a fixing portion 150. In the above, the fixing portion 150 is provided in the casing 115.

Moreover, the pipe 130 is fixedly connected to the fixing portion 150, such that the pipe 130 is fixed to the speaker 110 through the fixing portion 150. Optionally, a manner of connecting the pipe 130 to the fixing portion 150 is not limited, for example, they may be connected by a fixing element, and also may be integrally molded. In the present embodiment, in order to further improve the stability of connection between the pipe 130 and the speaker 110, the fixing portion 150 and the pipe 130 are integrally molded.

To sum up, with the earphone structure 100 provided in the present disclosure, by directly providing one end of the pipe 130 at the side of the speaker 110 having the sound outlet 113, thus the sound output from the sound outlet 113 can be transmitted to the outside space directly through the pipe 130, thus avoiding the problem of easy occurrence of reflection of the sound waves within a cavity due to presence of the cavity between the pipe 130 and the sound outlet 113 in the prior art, thereby overcoming the problem of sound coloration caused by the occurrence of reflection of the sound waves, and further overcoming the problem of poor user experience in the sound field and the sense of space. Secondly, by providing the pipe 130 in the step-shape structure, the diffusion sound transmission path can be formed, thus an object of quickly and effectively outputting the sound from the pipe 130 is achieved, further improving the sound field and the sense of space of the sound.

The above-mentioned are merely for preferred embodiments of the present disclosure, and not used to limit the present disclosure. For one skilled in the art, various modifications and changes may be made to the present disclosure. Any amendments, equivalent replacements, improvements, and so on, within the spirit and principle of the present disclosure, should be covered by the scope of protection of the present disclosure.

What is claimed is:

1. An earphone structure, comprising:

a speaker, comprising a sound producing vibrating diaphragm and a sound outlet, wherein the sound producing vibrating diaphragm is used to convert an electrical signal to a sound which is output through the sound outlet; and a pipe, wherein the pipe has one end provided at a side of the speaker having the sound outlet, and the other end extending along a direction away from the sound outlet, such that the sound output from the sound outlet is transmitted to an outside space, wherein areas of cross sections of the pipe in a radial direction are increasing successively in a direction away from the sound outlet, wherein each of the cross sections of the pipe in the radial direction comprises:

a first arc-shape portion;

a second arc-shape portion, having a radius of curvature smaller than that of the first arc-shape portion, wherein a first end of the second arc-shape portion is connected to a first end of the first arc-shape portion;

a third arc-shape portion, having a radius of curvature equal to that of the first arc-shape portion, wherein a first end of the third arc-shape portion is connected to a second end of the second arc-shape portion; and a fourth arc-shape portion, having a radius of curvature equal to that of the second arc-shape portion, wherein a first end of the fourth arc-shape portion is connected to a second end of the third arc-shape portion, and a second end of the fourth arc-shape portion is connected to a second end of the first arc-shape portion.

2. The earphone structure of claim 1, wherein the pipe is divided into multiple portions successively in the direction away from the sound outlet, wherein two neighboring portions are connected by a transition portion parallel to end faces of the two portions, so as to form a step-shape structure.

3. The earphone structure of claim 2, wherein a cross section of each of the portions of the pipe in an axial direction is an isosceles trapezoidal shape, and legs of any two isosceles trapezoidal shapes on same sides are parallel to each other.

4. The earphone structure of claim 3, wherein in any two neighboring isosceles trapezoidal shapes, one isosceles trapezoidal shape close to the sound outlet has a height smaller than that of the other isosceles trapezoidal shape that is away from the sound outlet.

5. The earphone structure of claim 1, wherein the cross sections of the pipe in the radial direction are in a circular shape, and have diameters successively increasing in the direction away from the sound outlet.

6. The earphone structure of claim 1, wherein the cross sections of the pipe in the radial direction are in an ellipse shape, and have major axes and minor axes respectively increasing successively in the direction away from the sound outlet.

7. The earphone structure of claim 1, wherein an arc length of the first arc-shape portion is equal to that of the third arc-shape portion, an arc length of the second arc-shape portion is equal to that of the fourth arc-shape portion and is smaller than that of the first arc-shape portion.

8. An earphone structure, comprising:

a speaker, comprising a casing, a sound producing vibrating diaphragm, and a sound outlet, wherein the sound producing vibrating diaphragm is provided inside the casing, the sound outlet is provided on a surface of the casing, wherein the sound producing vibrating diaphragm is used to convert an electrical signal to a sound which is output through the sound outlet;

a pipe, wherein the pipe has one end provided at a side of the speaker having the sound outlet, and the other end extending along a direction away from the sound outlet, such that the sound output from the sound outlet is transmitted to an outside space; and a fixing portion provided in the casing, wherein the fixing portion is integrally molded with the pipe, such that the pipe is fixed to the speaker through the fixing portion, wherein areas of cross sections of the pipe in a radial direction are increasing successively in a direction away from the sound outlet, wherein each of the cross sections of the pipe in the radial direction comprises:

a first arc-shape portion;

a second arc-shape portion, having a radius of curvature smaller than that of the first arc-shape portion, wherein a first end of the second arc-shape portion is connected to a first end of the first arc-shape portion;

a third arc-shape portion, having a radius of curvature equal to that of the first arc-shape portion, wherein a first end of the third arc-shape portion is connected to a second end of the second arc-shape portion; and a fourth arc-shape portion, having a radius of curvature equal to that of the second arc-shape portion, wherein a first end of the fourth arc-shape portion is connected to a second end of the third arc-shape portion, and a second end of the fourth arc-shape portion is connected to a second end of the first arc-shape portion.

9. The earphone structure of claim 2, wherein the cross sections of the pipe in the radial direction are in a circular shape, and have diameters successively increasing in the direction away from the sound outlet.

10. The earphone structure of claim 3, wherein the cross sections of the pipe in the radial direction are in a circular shape, and have diameters successively increasing in the direction away from the sound outlet.

11. The earphone structure of claim 4, wherein the cross sections of the pipe in the radial direction are in a circular shape, and have diameters successively increasing in the direction away from the sound outlet.

12. The earphone structure of claim 2, wherein the cross sections of the pipe in the radial direction are in an ellipse shape, and have major axes and minor axes respectively increasing successively in the direction away from the sound outlet.

13. The earphone structure of claim 3, wherein the cross sections of the pipe in the radial direction are in an ellipse shape, and have major axes and minor axes respectively increasing successively in the direction away from the sound outlet.

14. The earphone structure of claim 4, wherein the cross sections of the pipe in the radial direction are in an ellipse shape, and have major axes and minor axes respectively increasing successively in the direction away from the sound outlet.

* * * * *